US009486998B2

(12) United States Patent
Hayashi

(10) Patent No.: US 9,486,998 B2
(45) Date of Patent: Nov. 8, 2016

(54) LIQUID VISCOSITY DETECTING METHOD FOR LIQUID DROPLET EJECTING DEVICE, CONTROL METHOD FOR LIQUID DROPLET EJECTING DEVICE, AND LIQUID DROPLET EJECTING DEVICE

(71) Applicant: Ryuichi Hayashi, Ibaraki (JP)

(72) Inventor: Ryuichi Hayashi, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/641,847

(22) Filed: Mar. 9, 2015

(65) Prior Publication Data

US 2015/0258780 A1 Sep. 17, 2015

(30) Foreign Application Priority Data

Mar. 12, 2014 (JP) ..... 2014-049381

(51) Int. Cl.
*B41J 2/045* (2006.01)
*B41J 2/14* (2006.01)

(52) U.S. Cl.
CPC ..... *B41J 2/04581* (2013.01); *B41J 2/04571* (2013.01); *B41J 2/14233* (2013.01); *B41J 2002/14354* (2013.01)

(58) Field of Classification Search
CPC ..... B41J 2/04571; B41J 2/04581; B41J 2/16579; B41J 2/0451; B41J 2/045; B41J 2/14233; B41J 2002/14354
See application file for complete search history.

(56) References Cited

U.S. PATENT DOCUMENTS

2005/0122360 A1 6/2005 Sakagami et al.

FOREIGN PATENT DOCUMENTS

| | | | |
|---|---|---|---|
| JP | 3867787 | | 1/2007 |
| JP | 2011-140118 | | 7/2011 |
| JP | 2011-189655 | | 9/2011 |
| JP | 2011189656 A | * | 9/2011 |

OTHER PUBLICATIONS

Shinkawa, MachineTranslationofJP 2011189656 A, 2011.*

* cited by examiner

*Primary Examiner* — Geoffrey Mruk
*Assistant Examiner* — Scott A Richmond
(74) *Attorney, Agent, or Firm* — Oblon, McClelland, Maier & Neustadt, L.L.P.

(57) ABSTRACT

A liquid viscosity detecting method is performed in a liquid droplet ejecting device that includes a piezoelectric type droplet ejecting head to which a drive waveform is applied to pressurize a liquid chamber to eject a liquid droplet, a drive waveform generator to apply the drive waveform to the droplet ejecting head, and a residual vibration detector. The method includes detecting, by the residual vibration detector, amplitude values of multiple cycles of a residual vibration waveform occurring within the liquid chamber after the drive waveform is applied; calculating an attenuation ratio based on the amplitude values; and calculating a liquid viscosity in the liquid chamber based on the attenuation ratio.

11 Claims, 13 Drawing Sheets

LIQUID VISCOSITY DETECTING METHOD FOR LIQUID DROPLET EJECTING DEVICE, CONTROL METHOD FOR LIQUID DROPLET EJECTING DEVICE, AND LIQUID DROPLET EJECTING DEVICE

BACKGROUND OF THE INVENTION

1. Field of the Invention

The present invention relates to a liquid viscosity detecting method for a liquid droplet ejecting device, a control method for a liquid droplet ejecting device, and a liquid droplet ejecting device.

2. Description of the Related Art

Inkjet recording apparatuses using, for example liquid droplet ejecting devices, have been known as image forming apparatuses such as printers, facsimile machines, copiers, multifunction peripherals (MFP), etc. In the inkjet recording apparatuses, inkjet recording heads are adapted to eject ink droplet onto recording media, such as papers or viewgraphs (OHP sheet) to form a desired image. As the inkjet recording head, there is known a piezoelectric type head in which a piezoelectric element is used as a pressure generator element to pressurize the ink in an ink channel to cause a vibration plate that forms a wall of the ink channel to vibrate, which changes a volume of the ink channel to eject ink droplets.

The inkjet recording head is equipped with multiple nozzles to eject ink. Herein, ink viscosities fluctuate among the multiple nozzles, by being affected by change in the circumferential temperature and humidity and affected by self-heat generation during continuous driving. As the ink viscosities are changed among the nozzles, the ejecting speed of the respective nozzles vary, which may cause defective image formation such as image density fluctuation, image partly absent creating white lines, and color tone change. When the ink viscosity is further increased, the nozzle is clogged, the image in which the ink is partly absent creating white dots occurs.

In order to implement correcting and recovering appropriately as a countermeasure to the fluctuation in the ejecting speeds and nozzle clogging, it is necessary to detect the change in the ink viscosity.

Herein, immediately after a drive voltage (drive waveform) is applied, a residual pressure wave in the individual liquid chamber (ink channel) vibrates (residual vibration) the piezoelectric element. During the residual vibration, a counter electromotive force is generated in the piezoelectric element. As a method to detect the change in the ink viscosity, a residual vibration detection technique in which the counter electromotive force of the residual vibration is detected is proposed.

As one example technique, there is a residual vibration detector that is equipped with a residual vibration detection unit including a filter circuit, an amplification circuit, a comparison circuit, a logic circuit and so on; a transistor functioning as a switching element. Immediately after the drive waveform is applied, the piezoelectric element is connected to the residual vibration detection unit by switching the switching element, and the residual vibration detection unit acquires an elapsed period until the drive vibration waveform reaches a reference voltage Vref and a cycle of the residual vibration waveform. Then, an amplitude value is calculated in accordance with the ratio of the vibration cycle to the elapsed period until the residual vibration voltage reaches the predetermined reference voltage Vref, and with a condition that the residual vibration is a sine wave based on the residual vibration waveform. The ink viscosity is detected based on the magnitude of the amplitude values of a first half wave (JP-2011-189655-A).

In this example, the residual vibration waveform is incorporated into the residual vibration detection unit after the switching element is switched, and the amplitude value of the first half-wave is calculated based on the ratio between a cycle of the residual vibration waveform and the elapsed period until the residual vibration waveform reaches the predetermined reference voltage Vref, to detect the ink viscosity. However, variations in the ON-resistance/ON-period of the switching element directly affect the elapsed period until the residual vibration waveform reaches the reference voltage Vref, and accordingly a large variation occurs in the first half-wave amplitude values, so that a small change in the ink viscosity cannot be detected.

SUMMARY OF THE INVENTION

In view of the above circumstances, in one aspect, the present invention proposes a liquid viscosity detection method in the liquid droplet ejecting device including detecting amplitude values of a residual vibration waveform after a driving waveform is applied in an inkjet recording head, calculating an attenuation ratio of the residual vibration waveform, and accurately detecting a small change in the ink viscosity.

In an embodiment which solves or reduces one or more of the above-mentioned problems, the present invention provides a liquid viscosity detecting method in a liquid droplet ejecting device that includes a piezoelectric type droplet ejecting head to which a drive waveform is applied, to pressurize a liquid chamber to eject a liquid droplet, a drive waveform generator to apply the drive waveform to the droplet ejecting head, and a residual vibration detector, the method including: detecting, by the residual vibration detector, amplitude values of multiple cycles of a residual vibration waveform occurring within the liquid chamber after the drive waveform is applied; calculating an attenuation ratio based on the amplitude values; and calculating a liquid viscosity in the liquid chamber based on the attenuation ratio.

BRIEF DESCRIPTION OF THE DRAWINGS

A more complete appreciation of the disclosure and many of the attendant advantages thereof may be readily obtained as they become better understood by reference to the following detailed description when considered in connection with the accompanying drawings, wherein.

DETAILED DESCRIPTION OF THE PREFERRED EMBODIMENTS

Figure 1:
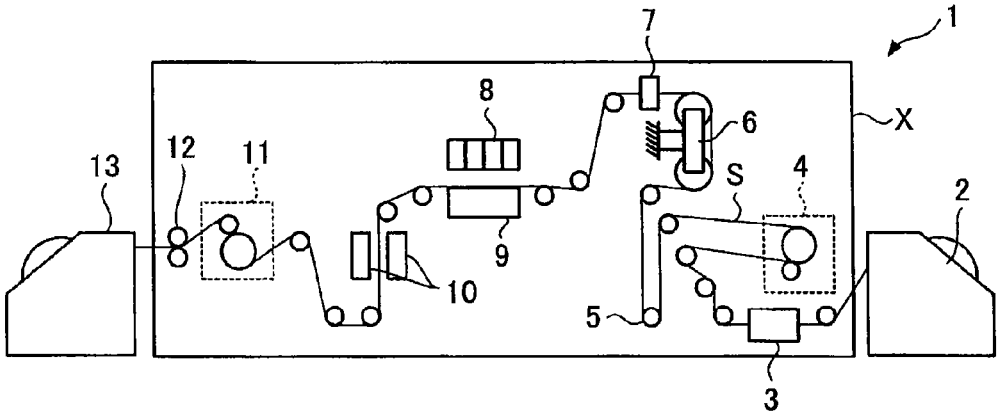
FIG. 1 is a schematic illustrating an entire configuration of an on-demand type line scanning inkjet recording apparatus.

In the following, embodiments of the present invention will be described with reference to the accompanying drawings. It should be noted that configuration elements that include substantially the same functional configurations in the present specification and the drawings are assigned the same reference numerals and the duplicated description is omitted.

<Entire Specification>

FIG. 1 is a schematic illustrating an entire configuration of an on-demand type line scanning inkjet recording apparatus 1. In FIG. 1, the inkjet recording apparatus 1 includes an inkjet ejecting apparatus body X, a recording medium supply unit 2, and a recording medium collection unit 13.

The inkjet apparatus body X includes a restriction guide 3, an in-feed unit 4, a dancer roller 5, an EPC 6, a conveyance meandering detector 7, an inkjet recording module 8, a platen 9, a drying module 10, an out-feed unit 11, and a puller 12.

The restriction guide 3 performs positioning of the recording medium S in a wide direction thereof. The in-feed roller 4 consists of a drive roller and a driven roller, to keep a tension force of a recording medium S constant. The dancer roller 5 outputs a positioning signal by moving in a vertical direction in accordance with the tension force of the recording medium S. The EPC (edge position controller) 6 controls positions of edges of the recording medium S. The platen 9 is provided facing the inkjet recording module 8. The out-feed unit 11 includes a driving roller and a driven roller to drive and convey the recording medium S at a setting speed. The puller 12 includes a driving roller and a driven roller to discharge the recording medium S to the outside of the inkjet apparatus body X.

The inkjet recording module 8 includes a line head (recording head 15) in which print nozzles (ejection openings) 16 (see FIG. 4) are arranged in an entire of a printing width. Color printing is performed using the respective line heads for black, cyan, magenta, and yellow. In printing, nozzle surfaces of the line heads 15 are supported so that a predetermine gap is kept constant between the nozzle surfaces and the platen 9. The inkjet recording module 8 ejects the ink in accordance with the conveyance speed of the recording medium S, which forms a color image on the recording medium S.

Herein, a line scanning type is used as the inkjet recording device 1, thereby enabling fast image forming.

Figure 2:
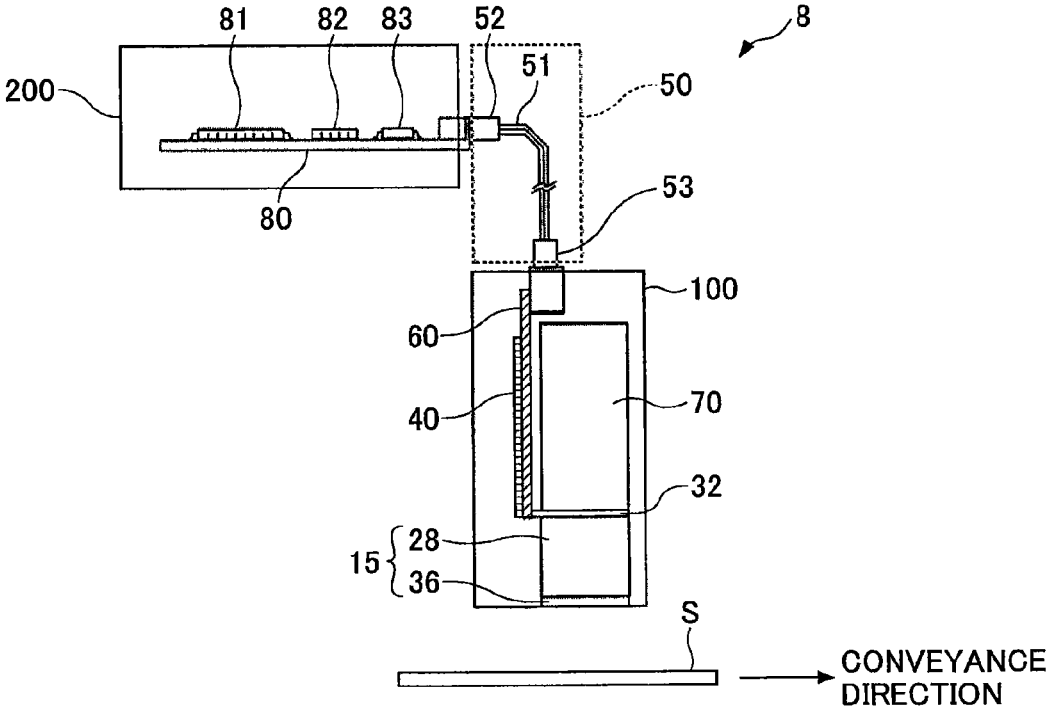
FIG. 2 is a side view illustrating a configuration of an inkjet recording module.

FIG. 2 is a side view illustrating a configuration of the inkjet recording module 8. As shown in FIG. 2, the inkjet recording module 8 mainly includes a drive controller 200, an inkjet recording head device (recording head device) 100, and a connection unit 50.

In the drive controller 200, a drive control substrate 80 is equipped with a controller 81 (see FIG. 10), a drive waveform generator 82, and a memory 83.

In the connection unit 50, a cable 51 connects a drive-control substrate side connector 52 and a head side connector 53. By doing so, the drive control substrate 80 sends and receives an analog signal and a digital signal to and from a head-side substrate 60 in which the recording head device 100 is installed.

As a control system, the recording head device 100 includes the head-side substrate 60, a residual-vibration detecting substrate 40, and a piezoelectric-element supporting substrate (head driving IC substrate) 32.

Furthermore, the recording head device 100 includes the recording heads 15 (also called inkjet recording head portion, piezoelectric-type liquid droplet ejecting head). The recording head 15 includes a rigidity plate 28 that contains piezoelectric elements 31, and a channel plate 36 in which the print nozzles 16 and individual pressure generating chambers 20 are formed (see FIG. 5). Further, an ink tank 70 containing the ink is provided adjacent to the recording head 15 and provided inside the recording head device 100.

Herein, the line scanning type inkjet recording device 1 has a line head structure so that recording heads 15 are arranged in a direction orthogonal to a direction in which the recording medium S is conveyed, that is a direction toward deep side (or toward near side) of the page surface in FIG. 2.

However, the structure of the inkjet recording device 100 is not limited to the line scanning type; alternatively, a serial scanning type printer that, while the one or multiple recording head is conveyed to the deep side in FIG. 2, the recording medium S is conveyed in the conveyance direction to form the image, or others may be used.

Figure 3:
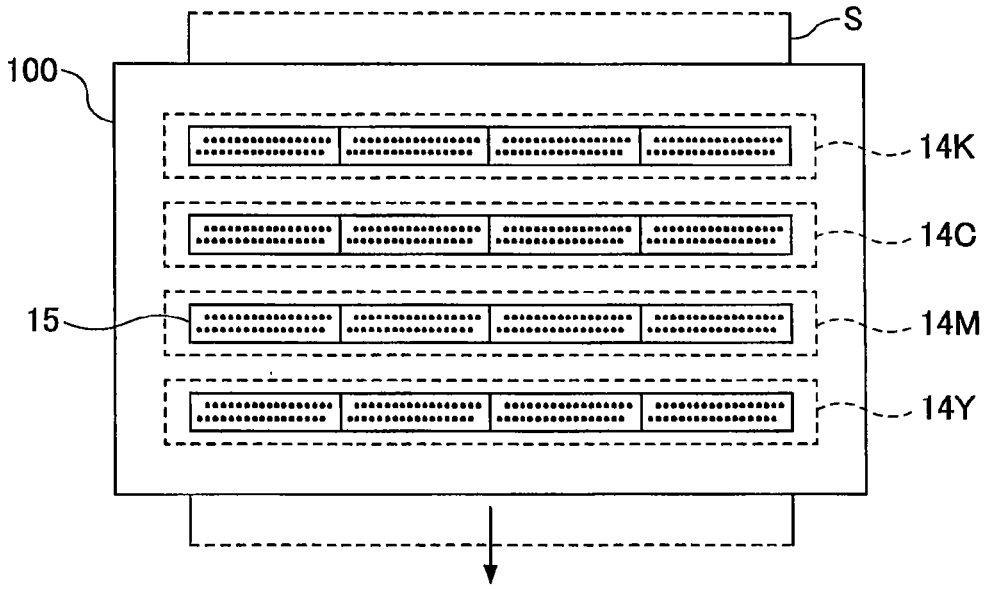
FIG. 3 is a schematic illustrating an inkjet recording head device configured with a line head structure.

FIG. 3 is a schematic illustrating the recording head device 100 configured with a line head structure. The recording head device 100 shown in FIG. 3 is configured with an assembly of four head arrays 14K, 14C, 14M, and 14Y. The head array 14K for black ejects black-color ink droplets, the head array 14C for cyan ejects cyan-color ink droplets, the head array 14M for magenta ejects magenta-color ink droplets, and the head array 14Y for yellow ejects yellow-color ink droplets.

The respective head arrays 14Y, 14C, 14M, and 14Y extend in a direction orthogonal to the conveyance direction of the recording medium (sheet) S. The recording heads 15 are configured as arrays as described above, which can ensure the wide printing region width.

Figure 4:
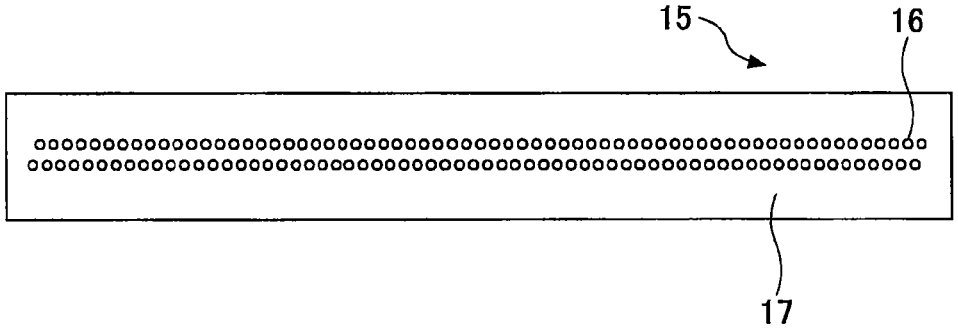
FIG. 4 is an enlarged view illustrating a bottom of a recording head shown in FIG. 3.

FIG. 4 is an enlarged view illustrating a bottom of the recording head 15 shown in FIG. 3. The multiple print nozzles 16 are arranged in zigzag on the nozzle face (bottom face) 17 of the recording head 15. In the embodiment shown in FIG. 4, 64 printing nozzles are arranged in one row, two rows are arranged in parallel, and the printing nozzles in an upper row and the printing nozzles in a lower row are arranged relative to each other like a zigzag. Thus, a great number of print nozzles 16 are arranged in zigzag, which can cope with high resolution.

Figure 5:
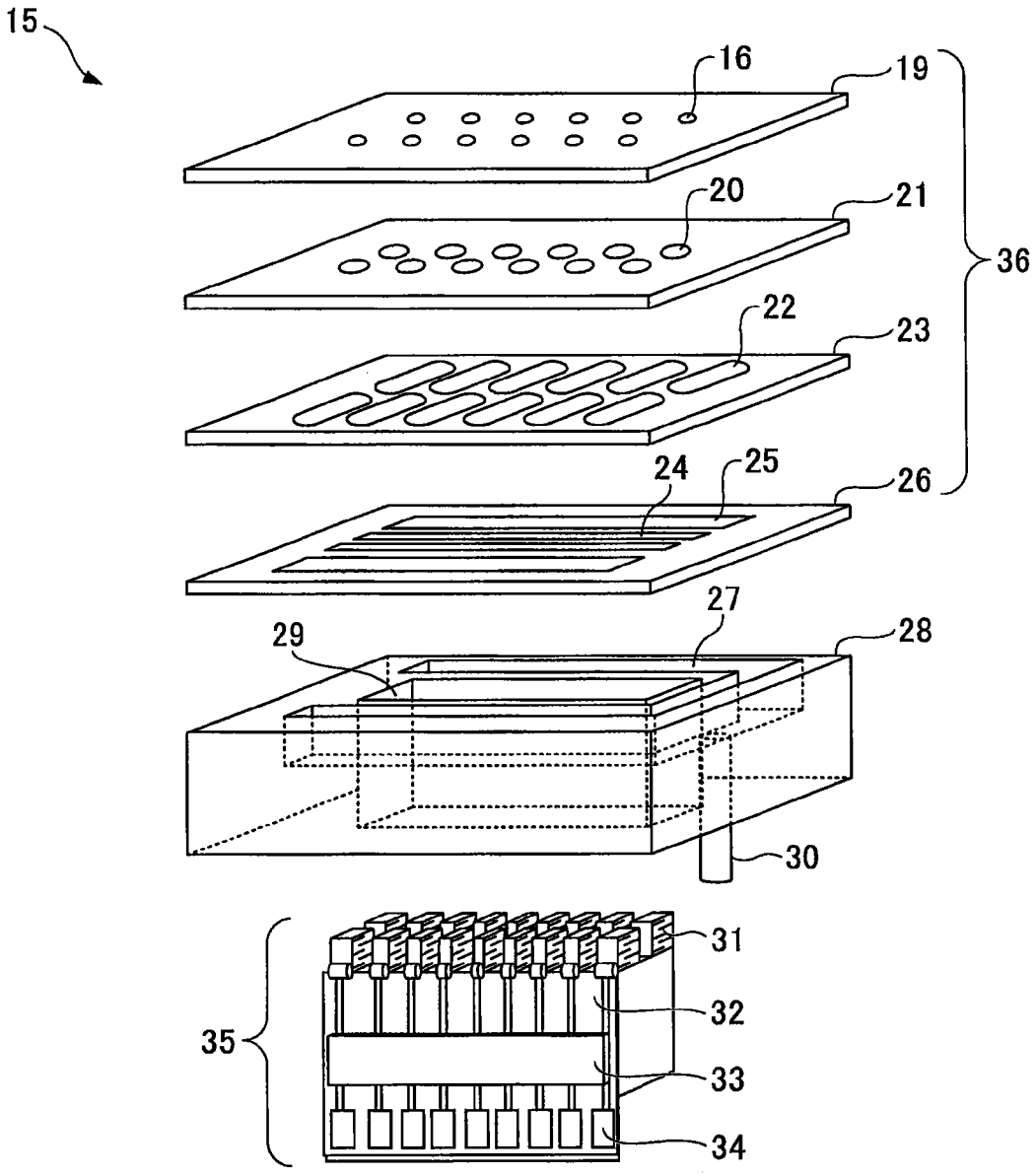
FIG. 5 is a configuration perspective diagram of the recording head.

FIG. 5 is a configuration perspective diagram of the recording head 15. The recording head 15 mainly includes a nozzle plate 19, a pressure chamber plate 21, a restrictor plate 23, a diaphragm plate 26, the rigidity plate 28, and a piezoelectric-element group 35.

The channel plate 36 is configured by superimposing the nozzle plate 19, the pressure chamber plate 21, the restrictor plate 23, and the diaphragm plate 26 in this order, and then by performing the positioning and connecting the plates 19, 21, 23, and 26. A great number of print nozzles 16, which are arranged in zigzag, are formed in the nozzle plate 19. The individual pressure generating chambers (liquid chamber) 20, corresponding to the print nozzles 16, are formed in the pressure chamber plate 21. A restrictor 22 is formed in the restrictor plate 23. The restrictor 22 is provided to communicate with a common ink channel 27 and the individual pressure generating chambers 20, to control the amount of ink flowing to the individual pressure generating chamber 20. The diaphragm plate 26 includes a vibration plate 24 and a filter 25.

By joining the channel plate 36 to the rigidity plate 28, the filter 25 is placed facing an opening of the common ink channel 27. An upper opening end of an ink guide pipe 30 is connected to the common ink channel 27 of the rigidity plate 28. A lower opening end of the ink guide pipe 30 is connected to the ink tank 70 (see FIG. 2) which the ink fills.

The piezoelectric-element supporting substrate 32, equipped with a piezoelectric-element driving IC (head driving IC) 33, holds the piezoelectric element 31. An electrode pad (piezoelectric pad) 34 is connected to the piezoelectric-element driving IC 33. A drive waveform generated in the piezoelectric-element driving IC 33 is applied to the piezoelectric element 31 via the electrode pad 34 (see FIG. 6A).

The piezoelectric-element group 35, constituted by arranging the great number of piezoelectric elements 31, is attached to the rigidity plate 28. The piezoelectric-element group is inserted into an opening area 29 of the rigidity plate 28, and free ends of the respective piezoelectric elements 31 are fixed and joined to the vibration plate 24. In this way, the recording head 15 is configured.

Figure 6A:
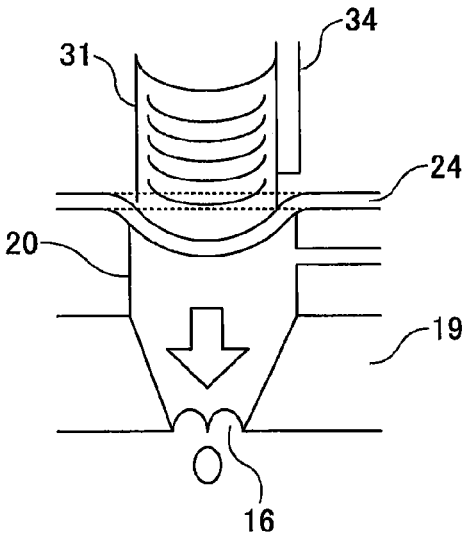
FIG. 6A is a schematic illustrating pressure change and operation of a residual vibration occurring within an individual pressure generation chamber of a print nozzle while ink is being ejected.
Figure 6B:
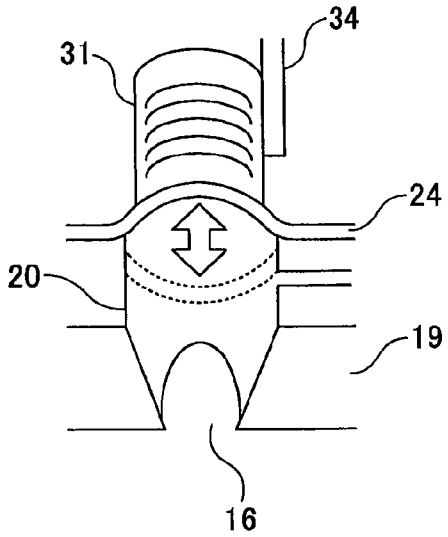
FIG. 6B is a schematic illustrating pressure change and operation of a residual vibration occurring within the individual pressure generation chamber of the print nozzle after ink has been ejected.

FIGS. 6A and 6B are schematics illustrating operation of the residual vibration waveform occurring in the individual pressure generating chamber (liquid chamber) 20 of the print nozzle 16. Specifically, FIG. 6A illustrates the pressure change occurring in the liquid chamber 20 of the print nozzle 16 while ink is being ejected. FIG. 6B illustrates the pressure change occurring in the liquid chamber 20 of the print nozzle 16 after ink has been ejected.

When the ink is being ejected as shown in FIG. 6A, the piezoelectric element driving IC 33 is turned ON/OFF, in response to image data transmitted from the controller 81 on the drive control substrate 80. The driving waveform generated in the drive waveform generator 82 is applied to the electrode pad 34. A stretching force of the piezoelectric element based on the drive waveform changes the pressure in the liquid chamber 20 via the vibration plate 24, which generates the pressure in a direction toward the print nozzle 16 to eject the ink.

Specifically, while ejecting, initially, by applying a falling wave of the driving waveform (see FIG. 7), the vibration plate 24 contracts and the individual pressure generating chamber (liquid chamber) 20 expands. By doing so, a meniscus that is a curved surface of the liquid (ink) is drawn into the liquid chamber 20 (the meniscus is moved upward in FIG. 6A). Then, after a rising wave of the drive waveform is applied, the vibration plate 24 expands (move downward in FIG. 6A) to contract and pressurize the liquid chamber 20 to eject the ink. Due to the ink ejecting operation, after the ink has been ejected, the position of the meniscus (liquid surface) continues being changed, that is, the meniscus and the vibration plate 24 vibrate for a predetermined period.

Herein, the electrode pad 34 is positioned adjacent to the vibration plate 24 and is provided near the liquid chamber 20. As the position of the meniscus (liquid surface) fluctuates depending on the ink viscosity after applying the drive waveform is stopped, the degree of the residual vibration in the liquid chamber 20 is changed. Therefore, in a detection of liquid viscosity of an embodiment of the present invention, it can be said that the ink viscosity adjacent to the meniscus in the liquid chamber 20 is detected.

After the ink has been ejected shown in FIG. 6B, a residual pressure wave generated in the liquid chamber 20 after the ink is ejected, is propagated to the piezoelectric element 31 via the vibration plate 24, and a residual vibration voltage becomes induced. By detecting the induced residual vibration voltage change, change in the ink ejecting speed and the ejecting amount due to change in the ink viscosity can be determined, and a clogged state of the print nozzle 16 can be determined.

Figure 7:
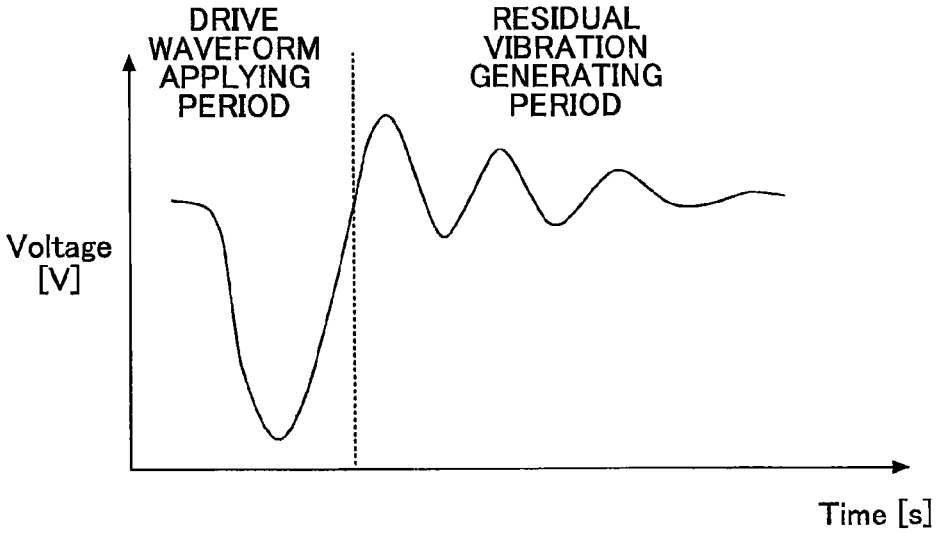
FIG. 7 is a graph schematically illustrating a drive waveform and a residual vibration waveform.

Herein, a pressure state of the individual pressure generating chamber 20 and a voltage change of the piezoelectric element 31 are described. FIG. 7 is a graph schematically illustrating a drive waveform and a residual vibration waveform. A drive waveform applying period in FIG. 7 corresponds to the state of the liquid chamber 20 shown in FIG. 6A. Before the state of FIG. 6A, falling of the drive waveform (see FIG. 7) causes the piezoelectric element 31 to pressurize, thus pressing up the vibration plate 24 and expanding the liquid chamber 20. Herein, in a period during which the liquid chamber 20 is being expanded, while the meniscus is drawn in, the ink is supplied from the ink tank 70 via the ink guide pipe 30 due to the decrease in the pressure.

Subsequently, as shown in FIG. 6A, rising of the drive waveform causes expanding the piezoelectric element 31, thus pressing down the vibration plate 24, contracting the liquid chamber 20, and ejecting the ink. After the drive waveform is applied (ink is ejected), the residual vibration occurs.

A residual vibration waveform generating period of FIG. 7 corresponds to the pressure state of the individual pressure generating chamber 20 shown in FIG. 6B. The residual pressure wave is propagated to the piezoelectric element 31, which is shaped by an attenuation vibration waveform as shown in FIG. 7.

Using above-described detection technique to detect the residual vibration, in the present embodiment, a residual vibration detector 400 (see FIG. 11), configured as a circuit on the residual-vibration detecting substrate 40, detects the residual vibration via the electrode pad 34 and the piezoelectric-element supporting substrate 32.

Figure 8:
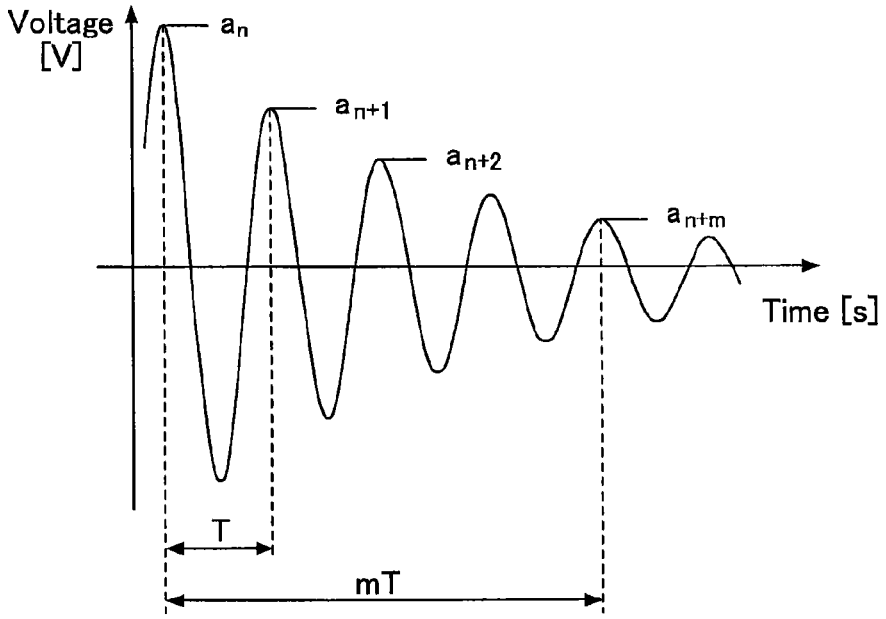
FIG. 8 is a schematic used for calculating an attenuation ratio based on an attenuation vibration waveform.

FIG. 8 is a schematic used for calculating an attenuation ratio based on an attenuation vibration waveform. A process to calculate an attenuation ratio ζ based on the attenuation vibration waveform shown in FIG. 7 is described below. An ideal formula of an attenuation vibration is represented as the following formula 1.

$$x = e^{-\zeta\omega_0 t}\left(x_0\cos\omega_d t + \frac{\zeta\omega_0 x_0 + v_0}{\omega_d}\sin\omega_d t\right) \tag{1}$$

Wherein, x represents a vibration displacement, relative to a time t, x0 represents an initial displacement, ζ represents an attenuation ratio, ω0 represents a natural vibration frequency, ωd represents a natural vibration frequency for an attenuation system, v0 represents an initial changing amount, and t represents a time.

Herein, the natural vibration frequency ωd for the attenuation system is represented as the following formula 2.

$$\omega_d = \sqrt{1-\zeta^2}\,\omega_0 \tag{2}$$

As a parameter that is required for calculating the attenuation ratio ζdet, a logarithm attenuation ratio δ exists. The logarithm attenuation ratio δ is represented by the following formula 3.

$$\delta = \frac{1}{m}\cdot \ell n\frac{a_n}{a_{n+m}} \tag{3}$$

In the formula 3 and FIG. 8, $\alpha_n$ represents "n"-th amplitude value, and $\alpha_{n+m}$ represents "n+m"-th amplitude value. In FIG. 8, T represents one cycle, the logarithm attenuation δ represents a value that is acquired by logarithmic transforming a rate of the amplitude change, dividing the logarithmic transformed value by m, and averaging per cycle. The numbers n and m are natural number.

The attenuation ratio ζ is calculated by dividing the logarithm attenuation ratio δ by 2π, as shown in the following formula 4.

$$\zeta = \frac{\delta}{2\pi} \tag{4}$$

That is, the attenuation ratio ζ has the information that the attenuation ratio of the amplitude values for the multiple cycles is averaged by 1 cycle.

As described above, the attenuation ratio ζ may be calculated by acquiring the logarithm attenuation ratio δ, so this process is required to merely detect the amplitudes of the residual vibration waveform.

Figure 9:
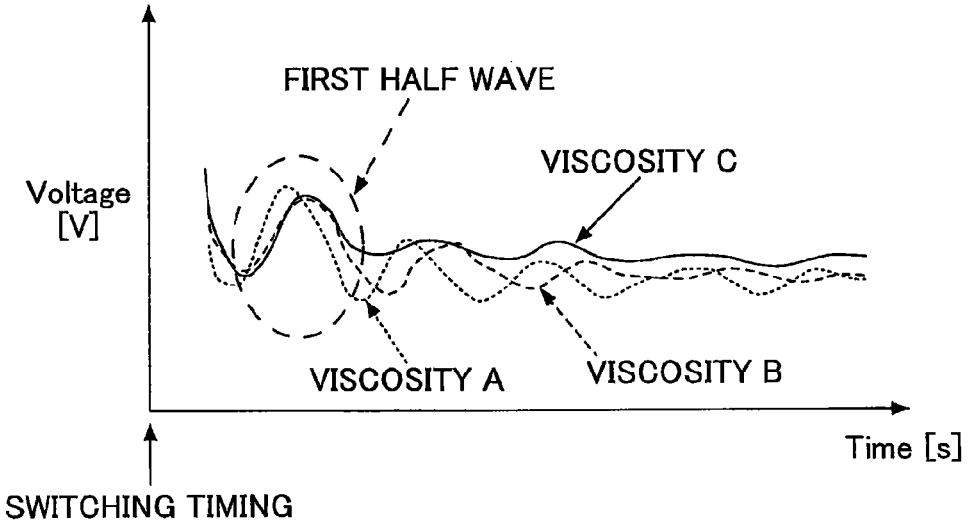
FIG. 9 is a graph illustrating a measured residual vibration waveform when several different ink viscosities are used.

FIG. 9 is a graph illustrating a measured residual vibration waveform when several different ink viscosities are used. Specifically, the graph shows the changes in the measured residual vibration waveforms when three types of ink viscosities are used. In FIG. 9, 0 points shows a switching timing when the driving waveform is switched to the residual vibration waveform by a switching element 42 (see FIG. 10).

The magnitude relation of the respective ink viscosities is the condition that a viscosity A is set to be 1, a viscosity B is 1.7, and a viscosity C is 3. As is clear from FIG. 9, the lower the viscosity of the ink (liquid), the larger the amplitude of the attenuation vibration. Furthermore, it is clear from FIG. 9 that if noise is interposed on the measured waveforms, the first half waves vary widely; and therefore, there is no correlation between the magnitudes of the respective ink viscosities and the amplitude values thereof.

Figure 13:
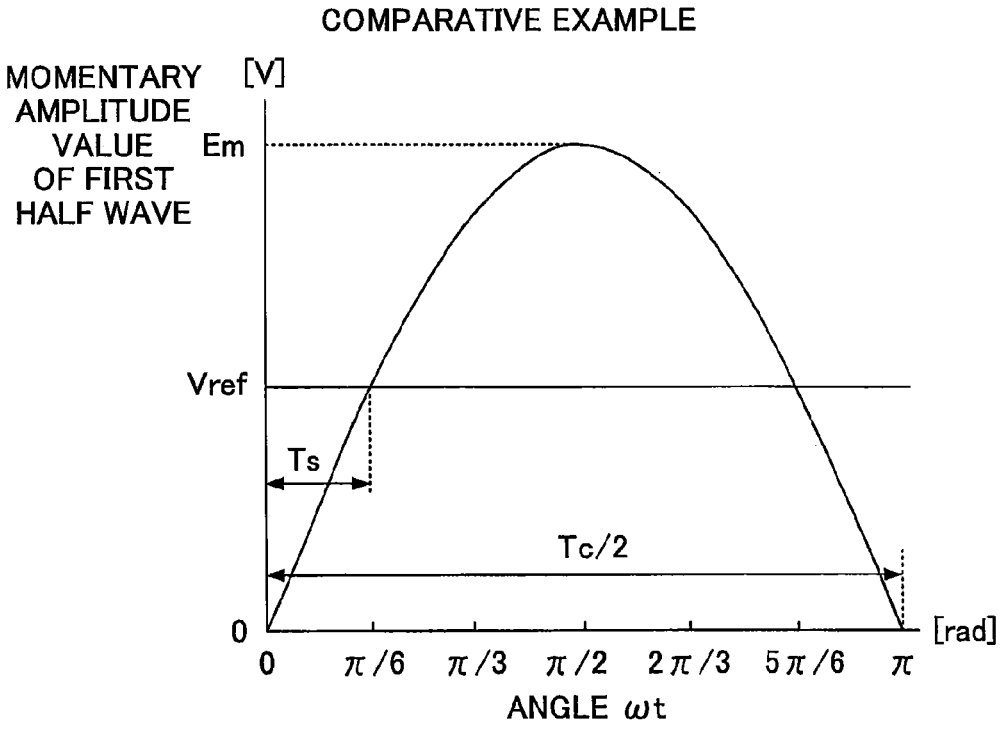
FIG. 13 is a graph illustrating correlation between an angle of a residual vibration and a momentary value of a first half amplitude value according to a comparative example.

Herein, in a comparative example (see FIG. 13), the change in the ink viscosity is detected using a magnitude of the amplitude of a first half wave.

However, the amplitudes of the first half wave between the viscosity B and the viscosity C of FIG. 9 are the almost same values, so the viscosities B and C are impossible to be distinguished.

In order to solve this problem, in the present embodiment, as a detecting means to detect liquid viscosity, a band-pass filter is used, and an ink viscosity detecting method using the attenuation ratio is applied. The band-pass filter can cut high-frequency/low-frequency noise components. The ink viscosity detecting method using the attenuation ratio can minimize variation due to the first half wave. The detailed control method is described below with reference to FIG. 12.

Figure 10:
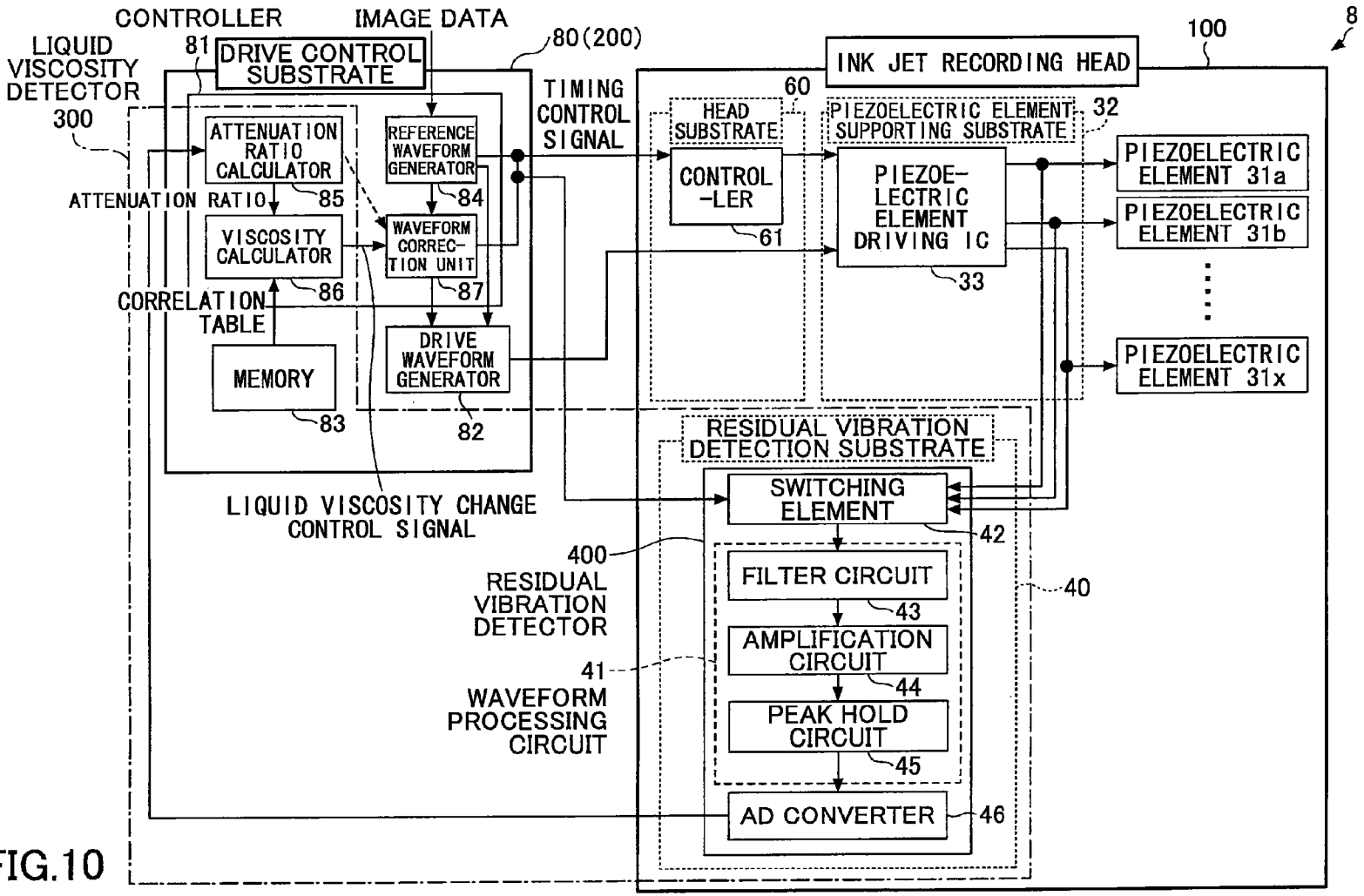
FIG. 10 is an entire block diagram illustrating a drive control of the inkjet recording module according to one of more embodiments of the present invention.

FIG. 10 is an entire block diagram illustrating a drive control of the inkjet recording module 8 of the present embodiment. As described with FIG. 2, the inkjet recording module (liquid droplet ejecting device) 8 includes the drive control substrate 80 and the recording head device 100.

The drive control substrate 80 mainly includes the controller 81, the drive waveform generator 82, and the memory 83. The controller 81 generates a timing control signal and drive wave data, based on the image data. The drive waveform generator 82 converts the generated drive wave data from digital to analog, and amplifies a voltage and a current of the analog data. The memory 83 stores the data relating to the attenuation ratio in advance.

The recording head device 100 includes multiple piezoelectric elements 31*a* through 31*x*, the head-side substrate 60 for driving and controlling the piezoelectric elements 31, the piezoelectric-element supporting substrate 32, and the residual-vibration detecting substrate 40. As described above, the piezoelectric-element supporting substrate 32 and the piezoelectric elements 31 are components of the recording head 15 (see FIGS. 2 and 3).

A head-side controller 61 is formed on the head-side substrate 60, and a piezoelectric-element driving IC 33 is formed on the piezoelectric-element supporting substrate 32. The switching element 42, a filter circuit 43, an amplification circuit 44, a waveform processing circuit 41 including a peak-hold circuit 45, and an AD converter 46 are formed on the residual-vibration detecting substrate 40. The waveform processing circuit 41, having a waveform processing function, can detect amplitude values for multiple cycles of the residual vibration waveform. Detailed configuration is described with FIG. 11.

The digital signal such as a timing control signal generated in the controller 81 of the drive control substrate 80 is transmitted to the recording head 15 with serial communication, and then is de-serialized by the controller 61 of the head-side substrate 60, and is input to the piezoelectric-element driving IC 33.

The piezoelectric-element driving IC 33 turns ON/OFF in accordance with the state (H/L, ON/OFF) of the timing control signal generated in the controller 81. In the drive control substrate 80, the drive waveform generated in the drive waveform generator 82 is input to the piezoelectric element 31 in the period during which the piezoelectric-element driving IC 33 is ON.

The controller 81 transmits a switching signal that is in synchronized with the timing control signal for transmitting to the piezoelectric-element driving IC 33, to the switching element 42, thereby also controlling the timing of fetching the residual vibration voltage, generated in the piezoelectric element 31 after the ink ejection, in the residual-vibration detecting substrate 40.

The amplitude values of the residual vibration held by the peak-hold circuit 45 are converted into digital values by the AD converter 46, and then are fed back to the controller 81.

The controller 81 calculates the attenuation ratio based on the amplitude values, and compares the detected attenuation ratio with data of the attenuation ratio stored in the memory 83. Thus, the change of the ink viscosities in the respective nozzles 16 is detected, and the drive waveform data is corrected so that the ejecting speed and the ejecting amount of the ink from the nozzles 16 are kept constant.

The controller unit 81 may be configured with a single circuit in all functions; alternatively, the respective control elements may be provided corresponding to specific functions in the controller 81. For example, the controller 81 may include a reference waveform generator 84, an attenuation ratio calculator 85, a viscosity calculator 86, and a waveform correction unit 87, for attaining respective functions.

The reference waveform generator 84 generates a control signal and drive wave data (reference drive waveform), based on the image data. The attenuation ratio calculator 85 calculates the attenuation ratio based on the amplitude values of the multiple cycles. The viscosity calculator 86 refers a correlation table and compares the calculated attenuation ratio with the attenuation ratio of the stored data to calculate the change of the ink viscosity in the respective nozzles 16. The waveform correction unit 87 corrects the drive waveform to be generated.

Herein, the controller 81 (attenuation ratio calculator 85) having a function to calculate the attenuation ratio is provided in the drive control substrate 80 shown in FIG. 10; alternatively, the configuration is not limited thereto. The controller may be provided in, for example, the residual-vibration detecting substrate 40 in the recording head 100 side.

The entire or a part of functions installed in the residual-vibration detecting substrate 40 may be provided in the drive control substrate 80 or the head substrate 60 collectively.

Herein, the configuration to attain the functions of the residual vibration detector 400 constituted by the circuits 41, 42, and 46 on the residual-vibration detecting substrate 40, and the functions of the attenuation ratio calculator 85 and the viscosity calculator 86 in the controller 81 can be collectively called a liquid viscosity detector 300 in embodiments of the present invention.

Herein, although the residual vibration voltages of the multiple piezoelectric elements 31 are detected by one group of the switching element 42, the waveform processing circuit 41, and the AD converter 46, while switching subsequently shown in FIG. 10; alternatively, multiple groups of switching elements, waveform processing circuits, and the AD converters may be provided so that the number of the groups is same as the number of the piezoelectric elements 31, and the ink viscosity state of all nozzles may be detected at the same time.

Further alternatively, all of the piezoelectric elements 31 are divided into some groups, where a switching element, a waveform processing circuit, and an AD converter are used for each of the groups. Detecting targets may be sequentially switched within the groups. With this configuration, the number of the nozzles for which the ink viscosity is detected at the same time can be increased, and the number of the circuits can be reduced.

Figure 11:
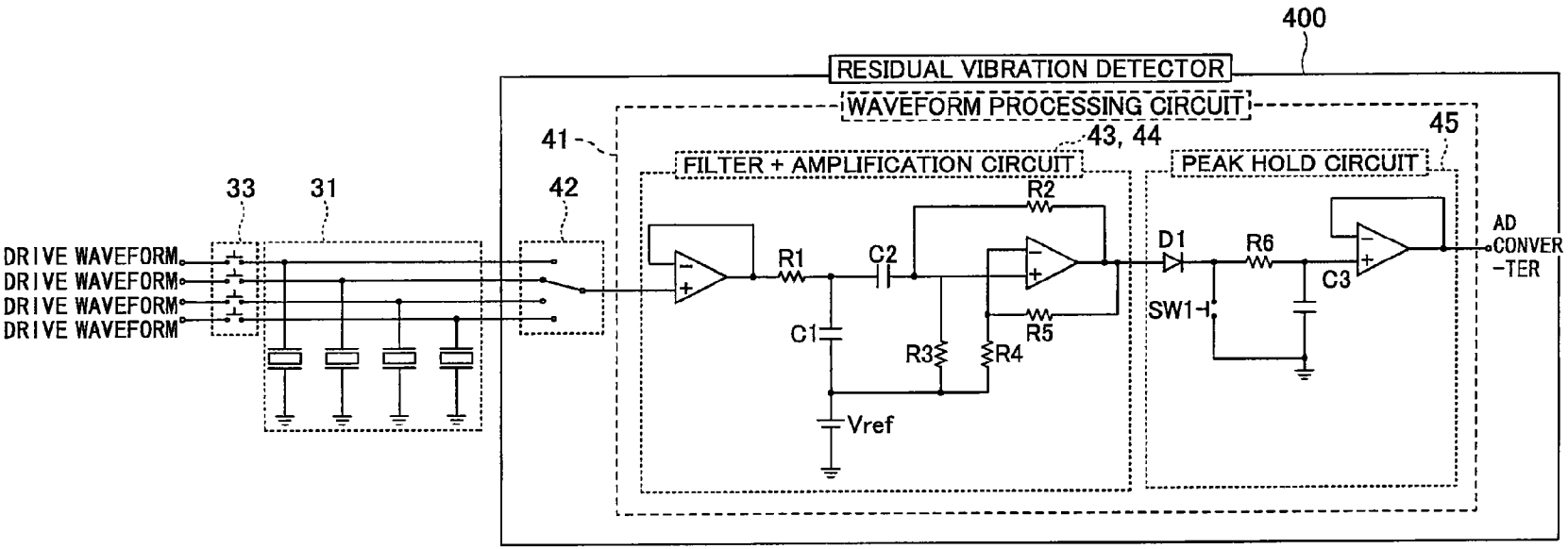
FIG. 11 is circuitry illustrating a residual vibration detecting substrate according to the present embodiments.

FIG. 11 is circuitry illustrating the residual-vibration detecting substrate 40 of the present embodiment. In the circuit shown in FIG. 11, by switching the piezoelectric-element driving IC 33 ON when the ink is ejected, the timing of the drive waveform applied to the respective piezoelectric element 31 and a timing of ejecting the ink are controlled.

Further, the switching element 42 is connected so that the waveform processing circuit 41 and the piezoelectric elements 31 can be connected and disconnected. After the ink is ejected, at the time when the piezoelectric-element driving IC 33 is tuned OFF, the switching element 42 is switched to connect the piezoelectric element 31 as a detecting target. By doing so, the piezoelectric element 31 is connected to the waveform processing circuit 41, so the waveform processing circuit 41 can recognize the amplitude values of the residual vibration waveform.

In FIG. 11, using the switching element 42, a single waveform processing circuit 41 detects two or more piezoelectric elements 31. With this configuration, the number of the circuits functioning as the residual vibration detector can be reduced.

As illustrated in FIG. 10, the waveform processing circuit 41 includes the filter circuit 43, the amplification circuit 44, and the peak-hold circuit 45. In FIG. 11, a configuration example of both the filter and the amplifier are structured together.

In the waveform processing circuit 41 as a part of the circuit configuration of the residual vibration detector 400 in the liquid viscosity detector 300, a buffer unit having a high-impedance receives the slightly small residual vibration waveforms, which suppresses adversely effect of the circuit of the residual vibration detector 400 to the residual vibration waveforms.

The filter circuit 43 and the amplification circuit 44 are configured with a band-pass filter amplification type, generally called Sallen-Key type. The characteristics of the filter circuit 43 are designed so that a certain constant passing bandwidth is present, setting a meniscus natural vibration frequency determined by the recording head 15 as a central frequency.

Further, for example, the filter amplification circuit (43, 44) sets bandwidth of "−3 dB" from both ends of the passing bandwidth so that sensitivity is approximately three times that of the passing bandwidth.

With this setting, variation in the natural vibration frequency caused by production tolerance of the head can be absorbed, and the noise in the high frequency band and the low-frequency band efficiently can be removed.

Accordingly, removing the noise components efficiently and extracting the signal components can be achieved.

An amplification degree of the amplification circuit 44 is set so that the amplified waveforms can be within an input enable range of the AD converter 46.

The peak-hold circuit 45 detects the amplitude values corresponding to the peak values of at least two the residual vibration (multiple cycles), and holds until the value is reset. The resistor R6 and the capacitor C3 of the peak-hold circuit 45 control the value (reset value) so that a discharge period is less than (or equal to) one half of the residual vibration cycle.

The peak-hold circuit 45 receives the reset signal from the head-side controller 61, for example, at the timing when the rising of the attenuation vibration waveform crosses the reference voltage Vref. Alternatively, the peak-hold circuit 45 may include or may be connected to a comparator (not shown) that detects the reset timing. The detected reset timing is input to the switch SW1. That is, the peak-hold circuit 45 includes a reset circuit having a reset function, which is controlled by the head-side controller 61, freely resets the resetting momentum (trigger). Thus, by adjusting the resetting momentum, the release timing of holding the amplitude values can be adjusted.

Yet alternatively, the peak-hold circuit 45 may include a comparator (not shown) having a comparative function, in addition to the reset circuit. In this case, the resetting momentum of the reset circuit is controlled by the comparator that is operated based on the residual vibration waveform. Specifically, the comparator (not shown) detects the timing when the residual vibration waveform crosses a predetermined voltage Vref and is input to the switch SW1. In this control, resetting can be performed by an analog system.

Herein, the configuration is not limited as described above, the configuration is sufficient as long as the reset timing when the amplitudes of the attenuation vibration waveform are recognized can be set. The circuit configuration of the peak-hold circuit 45 is not limited to the above; if it only includes the function to recognize the amplitude, the other configuration is applicable.

The filter circuit and the amplification circuit (43, 44) may be constituted by any types, as long as a filter, a non-reverse amplifier, and a reverse amplifier are provided, and may be not limited to the Sallen-Key type.

Herein, it is preferable that passive element constants of the resistors R1 through R5 and the capacitors C1 though C3 be configured to be variably controlled by the controller 81, depending on the difference in the natural vibration frequency due to the characteristics of the inkjet recording head 15. With this control, the states of the filter functions can be selectively detected.

"Selectively" control means that, for example, since the natural vibration frequencies for the respective recording heads 15 differ due to the production tolerance, by grasping the unevenness in the frequencies in the testing process, the passive element constants of the resistors R1 through R5 and the capacitors C1 though C3 are controlled so that the natural vibration frequencies in the respective recording heads 15 can be set as the center frequencies of the filter circuit 43.

Alternatively, in a case where it is difficult to control the constants of the filter circuit 43 for the respective recording heads 15; the controller 81 controls such that when the variation in the natural vibration frequencies of the recording head in a certain lot grasped in the testing process is large, the passing bandwidth of the filter circuit 43 applied for the recording heads 15 from this lot is set wider; and when the tested variation of the recording heads in another lot is small, the passing bandwidth of the filter circuit 43 applied for this recording head 15 from this lot is set narrower.

As described above, in the waveform processing circuit 41, the filter circuit 43 sets the passing bandwidth to remove the noise, the amplification circuit 44 amplifies the voltage waveforms after the waveform passes the filter circuit 43, and the peak-hold circuit 45 holds the amplitude values corresponding to the peak values of the amplified waveform for the predetermined time in the multiple cycles. A method for calculating the attenuation ratio, using the amplitudes recognized by this circuit, is described below with reference to FIG. 12.

Figure 12:
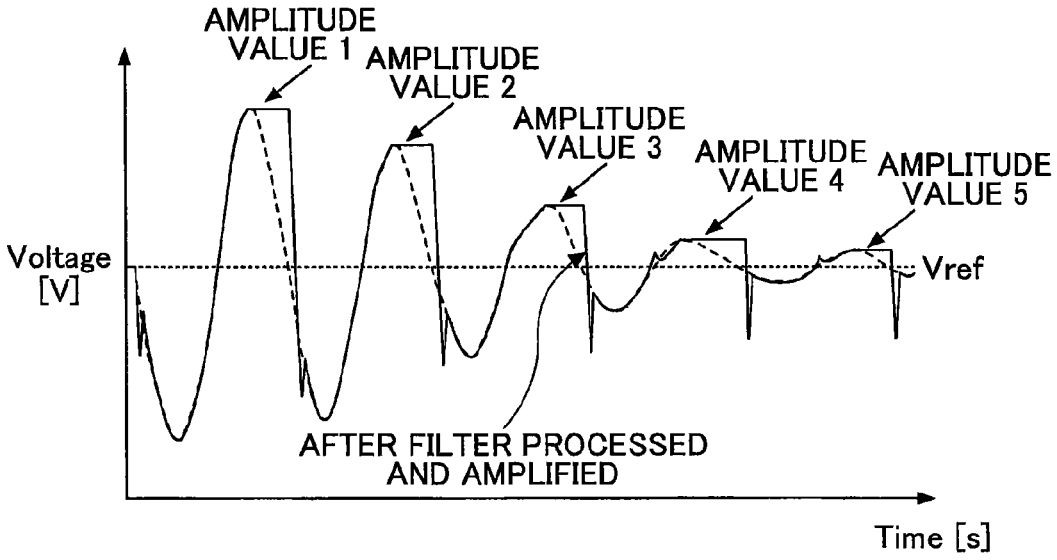
FIG. 12 is a graph illustrating a waveform while amplitude values are detected by using the circuit of FIG. 11 according to the present embodiments.

FIG. 12 is a graph illustrating a waveform while the amplitude values are detected by using the circuit of FIG. 11 of the present embodiment. In FIG. 12, a broken line represents an experiment waveform of the residual vibration after the filter processing and amplified processing, in a state where the circuit of the present embodiment is used. The solid line represents the experiment waveform of respective half waveforms whose peak is held in the peak-hold circuit 45.

The attenuation ratio $\zeta$ can be calculated based on at least two amplitude values, using the above-described formulas (3) and (4). Furthermore, calculating the attenuation ratio based on three or more amplitude values enables a highly accurate detection.

For example, FIG. 12 shows a waveform detected first through fifth half waveforms in an upper side of vertical amplitudes (upper amplitude values). Using FIG. 12, the attenuation ratio $\zeta$ is calculated by averaging 4 cycles. Alternatively, the attenuation ratio $\zeta$ may be calculated by detecting a lower side of the vertical amplitudes (lower amplitude values). In this case, as a detection example, in the circuit shown in FIG. 11, the amplification circuit 44 is constituted by a reverse amplitude circuit method. Thus, by detecting only one side of the upper amplitude values or the lower amplitude values, manufacturing cost can be decreased by reducing circuit size.

By contrast, a waveform processing circuit according to a comparative example includes a residual vibration detection unit that is equipped with the filter circuit, an amplifier circuit, a comparison circuit, and a logic circuit; a controller that performs calculation; and a switching element (ground terminal or transistor functioning as a switch). Immediately after the drive waveform is applied, the switching element is turned ON (release the ground end), which causes the residual vibration detection unit to take in the elapsed time Ts until the voltage reaches the predetermined voltage Vref shown in FIG. 13 and a cycle Tc of the residual vibration waveform.

Proposed is a determining method to determine the increases in the ink viscosity, in accordance with the ratio of the elapsed period Ts until the residual vibration voltage reaches the predetermined reference voltage Vref relative to the vibration cycle Tc taken in the residual vibration detection unit, and in accordance with a condition (formula 5) that the residual vibration is a sine wave.

$$Vref = Em \cdot \sin\left(\frac{2\pi}{Tc} \cdot Ts\right) \tag{5}$$

However, in the comparative example, since the unevenness in the ON-resistances/ON-periods of the switching elements directly affect to the elapsed time Ts until the voltage reaches the predetermined voltage Vref, the amplitude value of the first half wave calculated based on the comparison of the elapsed time Ts with the cycle Tc may fluctuate.

By contrast, in the present embodiment of the present invention, as shown in FIGS. 8 and 12, the multiple amplitude values $\alpha_n$ corresponding to peak values, which are not affected by time, are detected and averaged to calculate the attenuation ratio. Accordingly, comparing to the comparative example in which the elapsed time until the voltage reaches the reference voltage Vref is compared with the cycle Tc, even if the ON-resistances/ON-periods of the switching elements fluctuate, the switching variation can be suppressed and the change in the ink viscosity can be detected with a high degree of accuracy.

Herein, using at least two amplitude values, the attenuation ratio ζdet can be calculated, so it is preferable that the amplitude values for use be selected by the viscosity calculator 86 in the controller 81. By selecting the amplitude values for use, attenuation ratio can be calculated with a higher degree of accuracy.

For example, if the amplitude value of the first half wave fluctuates like the comparative example, the viscosity calculator 86 can calculate the attenuation ratio, by excluding the amplitude value of the first half wave that is more likely to be affected by the variation in the switching element 42 and then by averaging the amplitude values after the second half wave per cycle. Specifically, after the switching element 42 is switched, when the waveform processing circuit 41 detects the residual vibration waveform, the attenuation ratio ζ is calculated based on the amplitude values of the multiple cycles excluding the amplitude value of the first half wave that is more likely to be affected by the switching function. With this calculation, by excluding the first half wave having large variation, the effect of the variation in the ON-resistances/ON-periods of the switching elements 42 is further suppressed, which allows improving the calculation accuracy and detecting the change in the ink viscosity with a high degree of accuracy.

Alternatively, the attenuation ratio c may be calculated based on the amplitude values for the multiple cycles excluding the smallest amplitude value (smallest absolute value of amplitude) (e.g., fifth half wave in FIG. 12).

With this control, by removing the amplitude having relatively low signal component, the calculated accuracy of the attenuation ratio can be improved. Yet alternatively, by excluding both the first half wave and the smallest amplitude wave, the attenuation ratio ζ may be calculated. In addition, the selection type is not limited to the above.

As shown in FIGS. 11 and 12, in the present embodiment of the present invention, with a simple circuit configuration having only generic operational amplifier and the passive elements, the amplitude of the residual vibration waveform is detected and the attenuation ratio of the residual vibration waveform is calculated, which can detect the small change of the viscosity.

Figure 14:
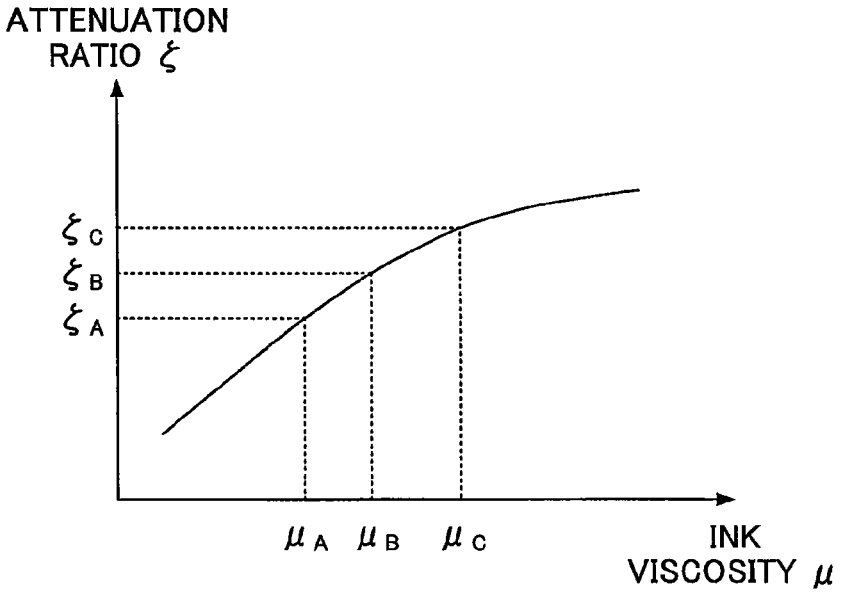
FIG. 14 is a graph illustrating a correlation between the attenuation ratio calculated by using the detection result of FIG. 12 and the ink viscosity.

FIG. 14 is a graph illustrating a correlation between the attenuation ratio ζ calculated by using the detection result of FIG. 12 and the ink viscosity μ. As is clear from FIG. 14, as the ink viscosity μ is increased, the attenuation ratio ζ is increased. A correcting method to correct the drive waveform to be generated for suppressing the fluctuation in the ejecting speed and the ejecting amount due to the change in the ink viscosity is described below.

Using the characteristics shown in FIG. 14, the drive waveforms for respective ink viscosities (drive waveform for $\mu_A$, drive waveform for $\mu_B$, drive waveform for $\mu_C$) are prepared in advance. By applying the drive waveform in accordance with ink viscosities calculated based on the detected attenuation ratios, the drive waveform is corrected. Further, a sign of the nozzle (outlet) clogged state due to increase in the ink viscosity is detected in advance based on the characteristics shown in FIG. 14, and the nozzle clogged state (ejecting clog) can be prevented.

In general, the state where the attenuation ratio ζ is equivalent to 1, is called critical attenuation, which is in a state where there is no residual vibration shown in FIG. 7. At this time, the recording head 15 enters the state where the nozzle 16 is completely clogged. However, it is considered that the clogged state of the nozzle that is the state in which the ink stops ejecting starts at a certain attenuation ratio before the nozzle is fully clogged, and when the ink viscosity is increased and the attenuation ratio is increased to a predetermined value that is smaller (lower) than 1.

The attenuation ratio and the nozzle-clogged state deeply depend on a nozzle diameter, a nozzle shape, and structural components of the ink. Herein, according to the experiment, when the attenuation ratio ζ becomes equal to or greater than 0.2, the nozzle clogging is more likely to occur.

When the nozzle is clogged, the ink is not ejected from the corresponding ink nozzle, thereby producing printed image in which the ink is partly absent, creating white dots.

Considering this condition, when the detected attenuation ratio is higher than the predetermined value, the clogged state in which ejecting opening is clogged is detected, and a correction/recovery method for the nozzle clogging are performed.

Figure 15:
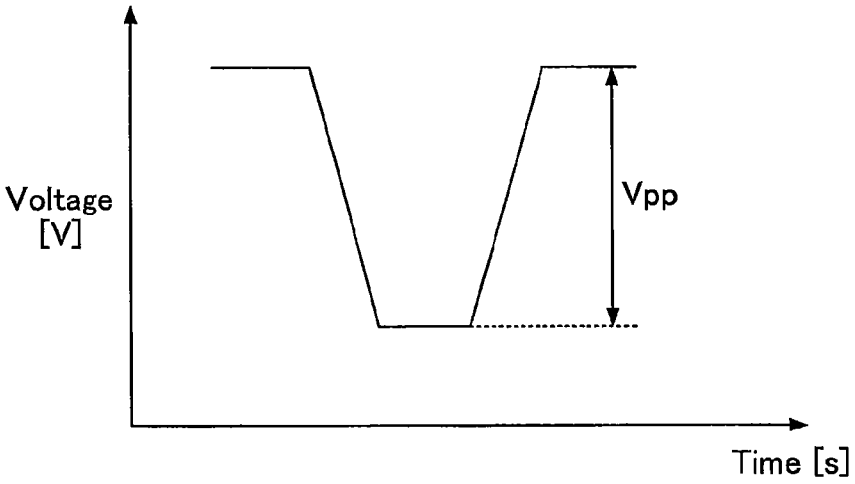
FIG. 15 is a graph illustrating one drive waveform used for the correction.

FIG. 15 is a graph schematically illustrating one drive waveform used for the correction. Below is described a correction method when a trapezoid shape driving waveform is used as one embodiment.

It is known that the voltage amplitude Vpp of a trapezoid-shape drive waveform is a proportional to the ejecting speed and the ejecting amount. That is, when it is determined that ink viscosity calculated based on the detected attenuation ratio is increased, the liquid ejecting speed and the ejecting amount are decreased. Therefore, by increasing a voltage gain of the drive waveform, and setting wider the voltage amplitude Vpp of the drive waveform shown in FIG. 15, the ejecting speed and the ejecting amount can be corrected.

Specifically, when correcting using this correcting method, by preparing the multiple drive waveforms whose voltage amplitudes are different corresponding to the multiple ink viscosities as shown in FIG. 14, the drive waveforms to be applied are corrected to correspond to the respective recognized ink viscosities.

Alternatively, as another correcting method, detecting the attenuation ratio and correcting the drive waveforms are repeated at any time so that the detected attenuation ratio ζ is within a predetermined range, without calculating the ink viscosity.

As described above, by adjusting the voltage gain and correcting the drive waveforms, the liquid ejecting speed and the ejecting amount are kept constant. Therefore, the ink clogging can be prevented and occurrence of the image failure (defective image formation), such as image density fluctuation, image partly absent creating white lines, and color tone change, and so on can be suppressed.

Figure 16:
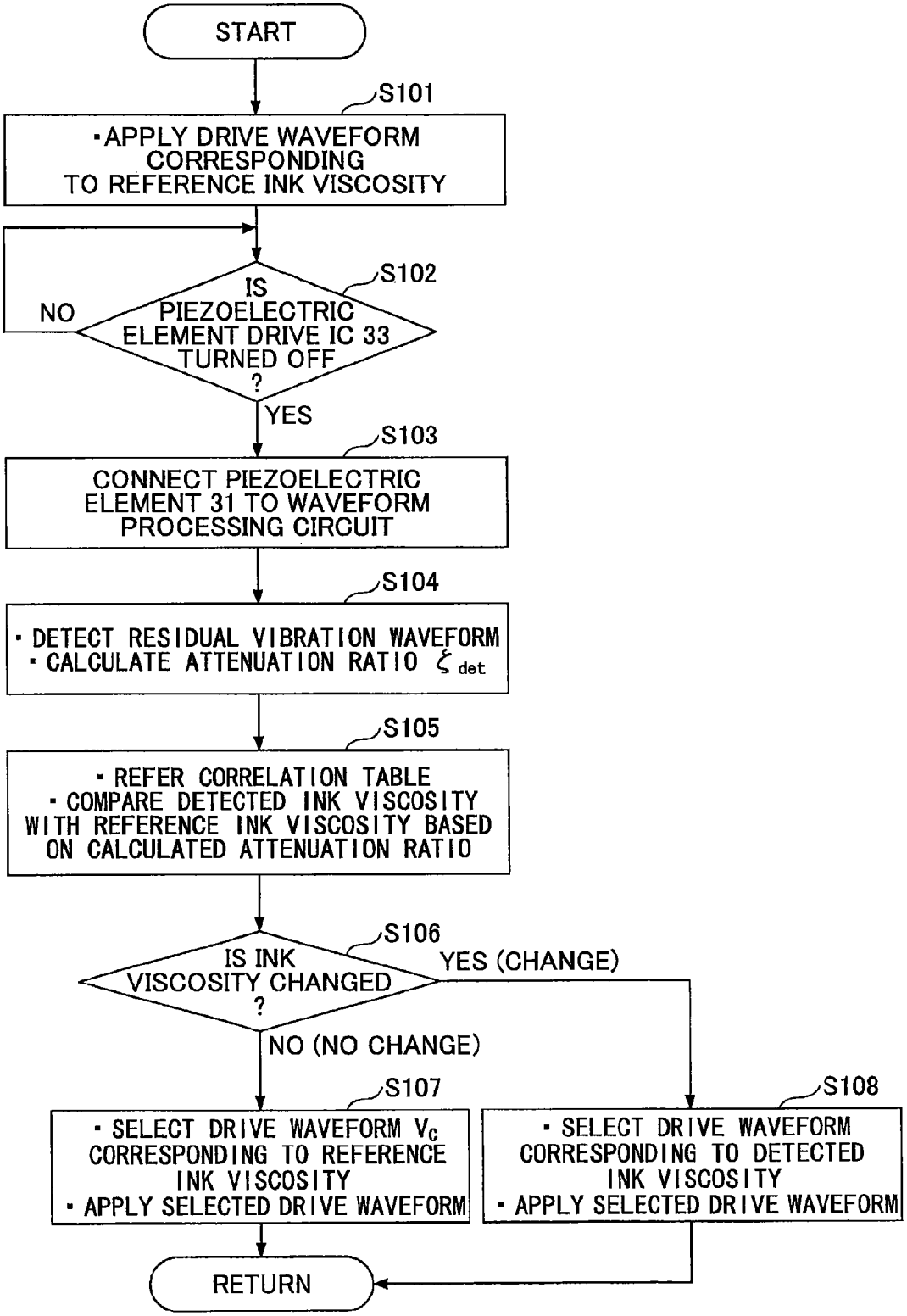
FIG. 16 is a flowchart illustrating an entire control of a liquid droplet ejecting device applying one example of a correcting method according to one or more embodiments, using the circuit shown in FIG. 11.

FIG. 16 is a flowchart illustrating an entire control of the liquid ejecting device applying one example of a correcting method of the embodiment using the circuit shown in FIG. 11. In this embodiment, for example, as shown in TABLE1, preparing multiple drive waveforms for different ink viscosities, and selecting the drives waveform corresponding to the attenuation ratio and the ink viscosity (liquid viscosity) based on a lookup table (TABLE 1 (basic table)), the drive waveform is corrected when the ink viscosity is changed.

TABLE 1

| CORRELATION BETWEEN ATTENUATION RATIO, INK VISCOSITY, AND DRIVE WAVEFORM | | |
|---|---|---|
| ATTENUATION RATIO | INK VISCOSITY | DRIVE WAVEFORM APPLIED TO THE NEXT |
| $\zeta_A$(LOWER) | $\mu_A$(SMALLER) | $V_A$(Vpp NARROWER) |
| $\zeta_B$ | $\mu_B$ | $V_B$ |
| $\zeta_C$ | $\mu_C$ | $V_C$ |
| $\zeta_D$ | $\mu_D$ | $V_D$ |
| $\zeta_E$(HIGHER) | $\mu_E$(GREATER) | $V_E$(Vpp WIDER) |

In TABLE 1, $\zeta_A$ through $\zeta_E$ represent values of the attenuation ratios, $\zeta_A$ is the minimum value, $\zeta_B$, $\zeta_C$, and $\zeta_D$ are arranged in increasing order, and $\zeta_E$ is the maximum value. Further, when the ink viscosity is increased, the voltage gain is increased, and the voltage amplitude Vpp of the drive waveform is set wider as shown in FIG. 15, which increases the ejecting speed, reduces the attenuation ratio, and prevents the nozzle clogging. Accordingly, as the driving waveforms corresponding to the ink viscosities $\mu_A$ through $\mu_E$, when the attenuation ratio is low and the ink viscosity is small, the drive waveform $V_A$, whose voltage gain is set lower and voltage amplitude Vpp is set narrower, is used; and when the attenuation ratio is high and the ink viscosity is great, the drive waveform $V_E$, whose voltage gain is set higher and voltage amplitude Vpp is set wider, is used.

At start of printing, a drive waveform for the reference ink viscosity is applied at step S101 (Hereinafter just called S) in FIG. 16. Then, at step S102, the head-side controller 61 monitors whether or not the piezoelectric-element driving IC is turned OFF, that is, whether or not applying the drive waveform is stopped. In case of NO at S102, the head-side controller 61 keeps monitoring. In case of YES at S102, the switching element 42 connects the piezoelectric element 31 and the waveform processing circuit 41 (S103).

The waveform processing circuit 41 performs the detecting process of the residual vibration, and the attenuation ratio calculator 85 of the controller 81 calculates the attenuation ratio ζdet (S104).

Then, at S105, the viscosity calculator 86 of the controller 81 compares the calculated attenuation ratio ζdet with the data of correlation table (Lookup table) among the attenuation ratios, the ink viscosities, and the drive waveforms, stored in the memory 83. Herein, a relative correlation between the attenuation ratio and the ink viscosity are stored in the memory 83 in advance as the correlation table between the attenuation ratio and the ink viscosity like that shown in TABLE 2.

Thus, with reference to the look-up table, the ink viscosities (liquid viscosities) corresponding to the calculated attenuation ratios for multiple ejection operations can be selected. By comparing the attenuation ratios ζ (calculated at S104) for multiple ejection operations, the multiple ink viscosities μ for multiple ejection operations corresponding to the calculated attenuation ratios selected from the look-up table can be compared.

Based on the comparison result of the ink viscosities, the viscosity calculator 86 determines whether (or not) the ink viscosity is changed (S106). Noted that, in a first ejection operation, whether the ink viscosity is changed can be determined by comparing the detected ink viscosity (selected from the correlation table) with the reference ink viscosity.

TABLE 2

| No | ATTENUATION RATIO AFTER FIRST EJECTION | ATTENUATION RATIO AFTER SECOND EJECTION | CHANGE IN ATTENUATION RATIOS | COMPARE CALCULATED INK VISCOSITY WITH REFERENCE INK VISCOSITY (COMPARE MULTIPLE INK VISCOSITIES) | DRIVE WAVEFORM APPLIED TO THE NEXT |
|---|---|---|---|---|---|
| 1 | $\zeta_C$ | $\zeta_A$(LOWER) | CHANGE (DECREASE) | $\mu_A < \mu_C$ | $V_A$ |
| 2 | $\zeta_C$ | $\zeta_B$ | CHANGE (DECREASE) | $\mu_B < \mu_C$ | $V_B$ |
| 3 | $\zeta_C$ (CORRESPONDING TO REFERENCE INK VISCOSITY) | $\zeta_C$ | NO CHANGE | $\mu_C = \mu_C$ | $V_C$ |
| 4 | $\zeta_C$ | $\zeta_D$ | CHANGE (INCREASE) | $\mu_D > \mu_C$ | $V_D$ |
| 5 | $\zeta_C$ | $\zeta_E$(HIGHER) | CHANGE (INCREASE) | $\mu_E > \mu_C$ | $V_E$ |

In this disclosure, "change in the viscosity" means that change in the attenuation ratio calculated based on the residual waveform when the liquid is ejected at multiple times and the change in the attenuation ratios is detected. For example, a first the ejecting operation of the drive waveform is applied (a single droplet is ejected), a residual vibration waveform occurs. The attenuation ratio for the first ejection operation is calculated based on the amplitude value $\alpha_2$ and the amplitude value $\alpha_3$ (alternatively, the attenuation ratio may be calculated based on the amplitude values $\alpha_3$ and $\alpha_4$, or based on the amplitude values $\alpha_2$, $\alpha_3$, and $\alpha_4$). Then, the attenuation ratio for a second ejection operation is calculated based on the amplitude values $\alpha_2$ and $\alpha_3$. By comparing the attenuation value for the first ejection operation based on the amplitude values $\alpha_2$ and $\alpha_3$ with the attenuation value for the second ejection operation based on the amplitude values $\alpha_2$ and $\alpha_3$, the change in the viscosity is detected.

When the ink viscosity is not changed in the case of YES at S106 ($\mu_C$=$\mu_C$), without correcting the drive waveforms, the drive waveform generator 82, to which the reference waveform generator 84 is input, applies the drive waveforms corresponding to the reference ink viscosity ($\mu_c$) (S107).

When the ink viscosity is changed in the case of YES at S106 ($\mu_A$>$\mu_C$), the waveform correction unit 87 corrects the drive waveforms (outputs a control signal to control) so that the drive waveform corresponds to the detected ink viscosity ($\mu_A$). The drive waveform generator 82 outputs the corrected waveform to the piezoelectric-element driving IC 33 to apply the voltage to the piezoelectric elements 31. That is, when the change in the ink viscosity is detected, the drive waveform to be applied is selected to correspond to the ink viscosity after the ink viscosity is changed.

As described above, by correcting the drive waveforms, the ink ejecting speed and the ejecting amount can be directly corrected.

Figure 17:
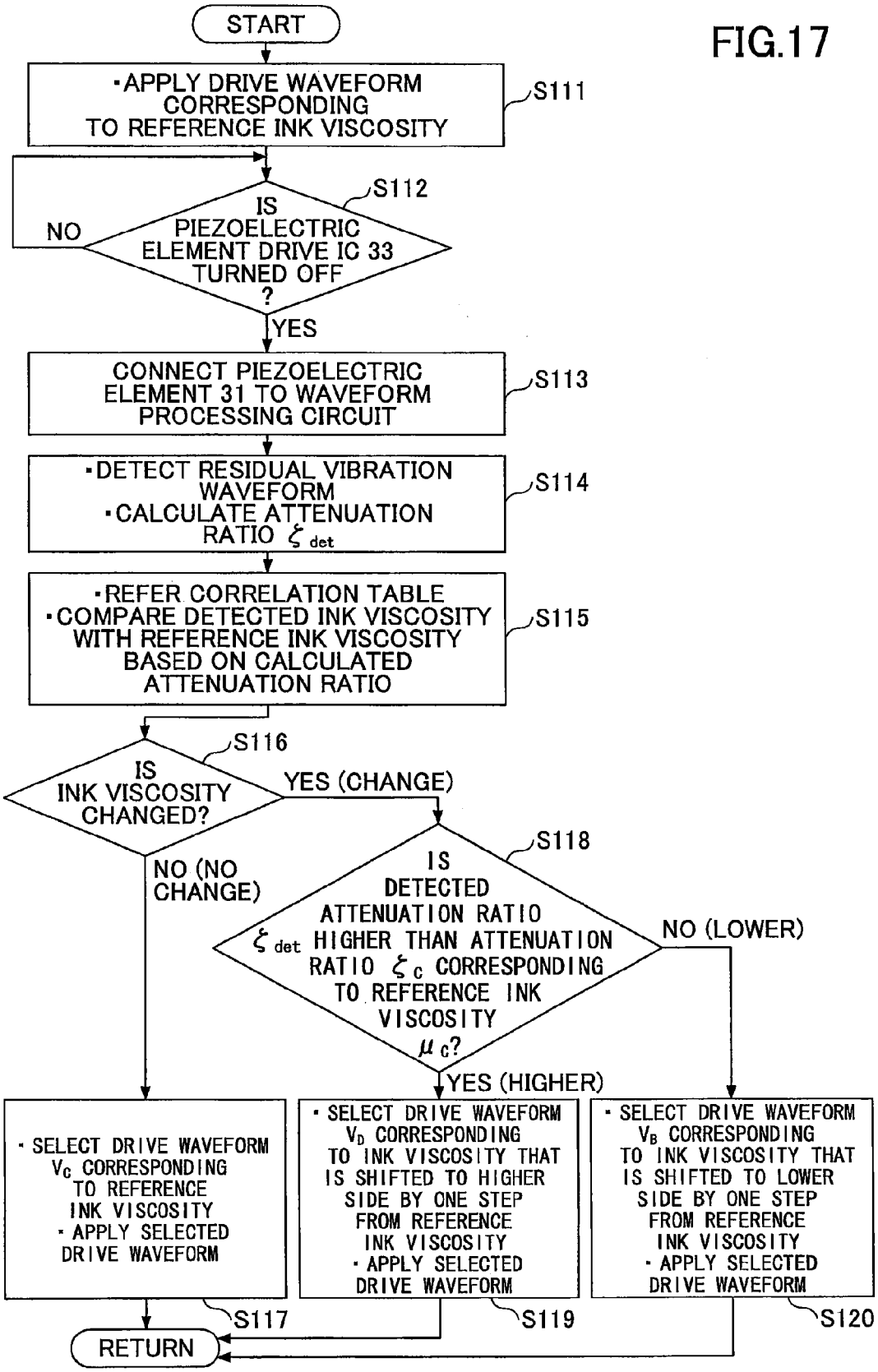
FIG. 17 is a flowchart illustrating an entire control of the liquid droplet ejecting device applying another example of a correction method according to one or more embodiments, using the circuit shown in FIG. 11.

FIG. 17 is a flowchart illustrating overall control of the liquid ejecting device including another example of a correction method of the present embodiment using the circuit shown in FIG. 11. Since the steps S111 through S117 are identical operation to the steps S101 through S107 in FIG. 16, the description thereof is omitted. The viscosity calculator 86 determines whether or not the ink viscosity is changed (S116), using the calculated attenuation ratio ζdet with reference to the data of correction table among the attenuation ratio, the ink viscosity and the drive waveform (e.g., TABLE 3) (S116). Herein, when the ink viscosity is changed in case of YES at S116, whether the detected attenuation ratio ζdet is higher than the attenuation ratio $\zeta_C$ corresponding to the reference ink viscosity $\mu_C$ is determined (S118).

In the present embodiment, when the detected attenuation ratio ζdet is higher than the attenuation ratio $\zeta_C$ corresponding to the reference ink viscosity $\mu_C$ (YES, S118), the drive waveform, corresponding to the ink viscosity (liquid viscosity) that is shifted to a higher side by one step in a correlation table (TABLE 3), is applied (S119). To the contrary, when the detected attenuation ratio ζdet is lower than the attenuation ratio ζc corresponding to the reference ink viscosity $\mu_C$ (NO, S118), the drive waveform, corresponding to the ink viscosity that is shifted to a lower side by one step in TABLE 3, is applied (S120). Herein, TABLE 3 shows a control correlation table of the present embodiment, using "shifting one side".

TABLE 3

| No. | ATTENUATION RATIO AFTER FIRST EJECTION | ATTENUATION RATIO AFTER SECOND EJECTION | CHANGE IN ATTENUATION RATIOS | COMPARE CALCULATED INK VISCOSITY WITH REFERENCE INK VISCOSITY (COMPARE MULTIPLE INK VISCOSITIES) | DRIVE WAVEFORM APPLIED TO THE NEXT |
|---|---|---|---|---|---|
| 1 | $\zeta_C$ | $\zeta_A$(LOWER) | CHANGE (DECREASE) | $\mu_A < \mu_C$ | $V_B$ |
| 2 | $\zeta_C$ | $\zeta_B$ | CHANGE (DECREASE) | $\mu_B < \mu_C$ | $V_B$ |
| 3 | $\zeta_C$ (CORRESPONDING TO REFERENCE INK VISCOSITY) | $\zeta_C$ | NO CHANGE | $\mu_C = \mu_C$ | $V_C$ |
| 4 | $\zeta_C$ | $\zeta_D$ | CHANGE (INCREASE) | $\mu_D > \mu_C$ | $V_D$ |
| 5 | $\zeta_C$ | $\zeta_E$(HIGHER) | CHANGE (INCREASE) | $\mu_E > \mu_C$ | $V_D$ |

Herein, one control example of No. 5 in TABLE 3 is described.

In TABLE 3, No. 5 shows a correction of the drive waveform in a case where the attenuation ratio $\zeta_E$ after a second ejection is greatly changed from the reference attenuation ratio ζc. In this case, if the voltage $V_E$ having wider voltage amplitude Vpp is suddenly applied as the drive waveform, the load on the piezoelectric element is great, which may cause the piezoelectric element 31 to degrade.

In order to solve this problem, the drive waveform is corrected by preparing the multiple drive waveforms corresponding to the multiple ink viscosities in advance, and by selecting the drive waveform corresponding to the ink viscosity that is shifted to the higher side or the lower side by one step from the liquid viscosity of the liquid droplet immediately before the ink viscosity is changed. By doing so, while degradation of the piezoelectric element 31 is prevented, the correction can be achieved. Specifically, ejection operation is performed, and based on the attenuation ratio calculated from the residual waveform, the drive waveform, which is shifted to the higher side ($V_D$) or the lower side ($V_B$) by one step from the drive waveform ($V_C$) of the ejection (First ejection) immediately before the ejection (Second ejection) whose viscosity is changed from the reference ink viscosity $\mu_C$, is selected.

With this control, since the changing amount of the drive waveform becomes moderate, without significantly changing the voltage to the piezoelectric element 31, the ink ejecting speed and the ejecting amount can be corrected, which can prevent the degradation of the piezoelectric element 31.

Figure 18:
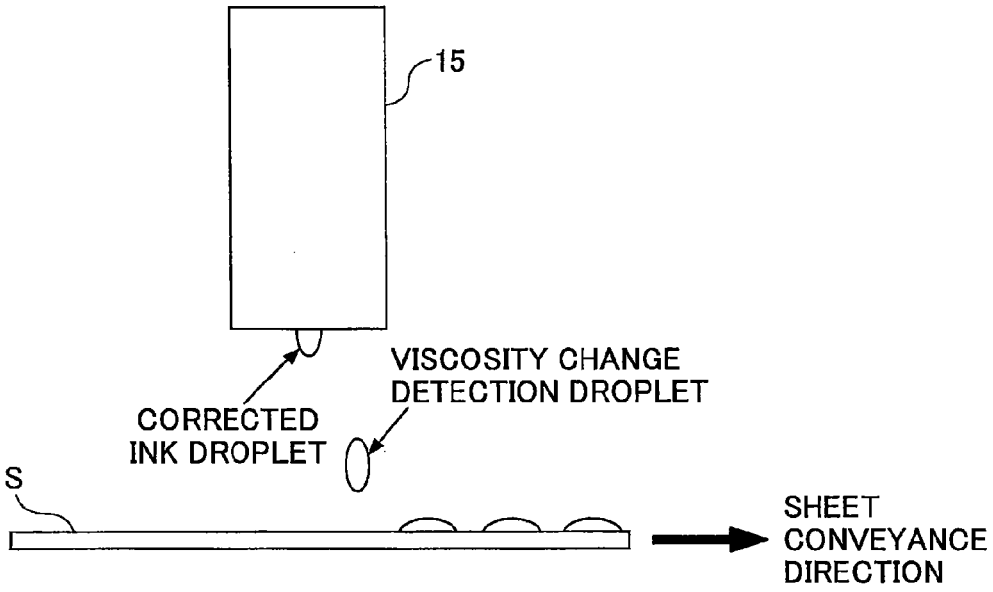
FIG. 18 is a schematic illustrating one example of a correction timing according to one or more embodiments of the present invention.

FIG. 18 is a schematic illustrating one example of a correction timing according to the present embodiment of the present invention. In the process of forming image on the recording medium S while the recording medium S is conveyed in a conveyance direction, when the change in the ink viscosity is detected in a certain page in printing, the drive waveform is corrected at the ink droplet following the ink droplet generating the residual vibration that has been detected that ink viscosity is changed, which can prevent the image failure in the page.

Figure 19:
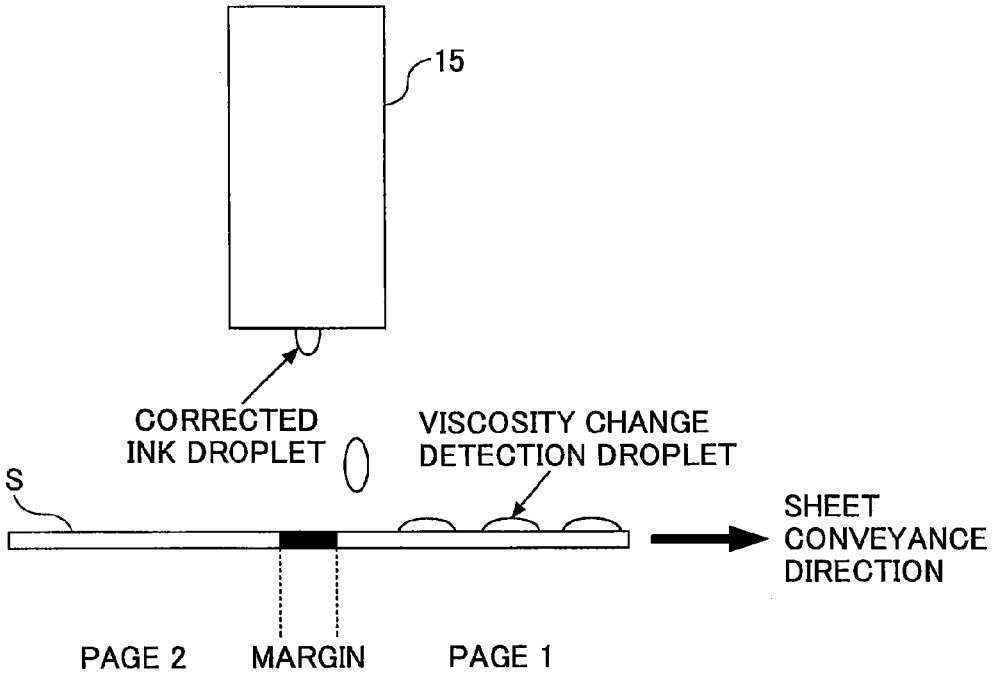
FIG. 19 is a schematic illustrating another example of a correction timing according to one of more of embodiments of the present invention.

FIG. 19 is a schematic illustrating another example of a correction timing of the present embodiment of the present invention. In the process of forming image on the recording medium S while the recording mediums S is conveyed in a conveyance direction, when the change in the ink viscosity is detected in a certain page in printing, the drive waveform is not corrected in the same page, and the drive waveform is corrected in an area where the ink is not formed. In FIG. 19, the drive waveform is corrected in a margin (area between pages) of the recording medium S, which can prevent the image failure on the next page.

Figure 20:
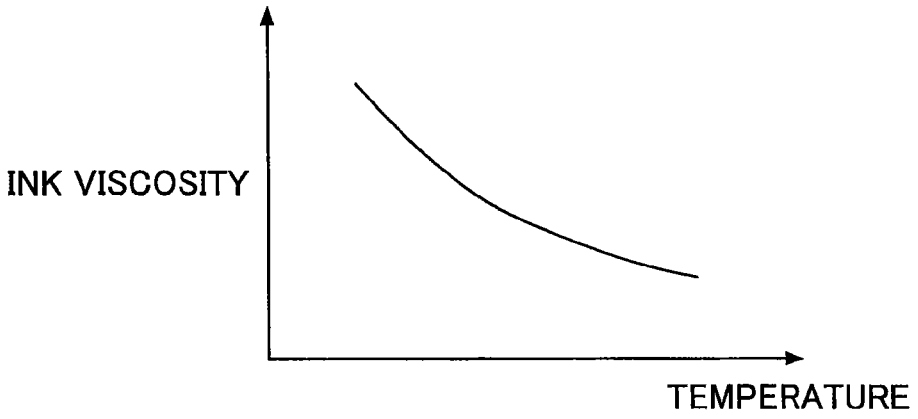
FIG. 20 shows a correlation diagram between the ink viscosity and a temperature.

FIG. 20 shows a correlation diagram between the ink viscosity and the temperature. The ink viscosity can be acquired based on the calculated attenuation ratio shown in FIG. 14 and the correlation between the ink viscosity and the liquid temperature is acquired based on experiment values shown in FIG. 20, so the liquid temperature can be calculated based on the attenuation ratio. Accordingly, the liquid temperature can be monitored using the attenuation ratio, so it is not required to provide a temperature detector, such as a thermistor.

In embodiments of the present invention, as shown in FIGS. 8 and 12, the attenuation ratio is calculated by detecting multiple amplitude values $\alpha_n$ corresponding to peak values of the residual vibration waveform and averaging the multiple amplitude values. Thus, even if the ON-resistances/ON-periods of the switching elements 42 may fluctuate, the effect of switching variation can be suppressed, and change in the ink viscosity can be accurately detected.

Furthermore, if the amplitude values of the first half wave fluctuate, the attenuation ratio, which is averaged for each cycle based on the multiple half waves since the second half wave, is used; thereby the effect of the fluctuation is prevented and change in the ink viscosity can be accurately detected.

The present invention is not limited to the specifically disclosed embodiments, and variations and modifications may be made without departing from the scope of the present invention.

The present application is based on Japanese Priority Application No. 2014-049381 filed on Mar. 12, 2014, the entire contents of which are hereby incorporated herein by reference.

What is claimed is:

1. A liquid viscosity detecting method in a liquid droplet ejecting device that includes a piezoelectric type droplet ejecting head to which a drive waveform is applied, to pressurize a liquid chamber to eject a liquid droplet, a drive waveform generator to apply the drive waveform to the droplet ejecting head, and a residual vibration detector, the method comprising:

detecting, by the residual vibration detector, amplitude values of multiple cycles of a residual vibration waveform occurring within the liquid chamber after the drive waveform is applied;

calculating a logarithm attenuation ratio based on the detected amplitude values of the multiple cycles;

calculating a damping ratio based on the calculated logarithm attenuation ratio; and calculating a liquid viscosity in the liquid chamber based on the calculated damping ratio.

2. The liquid viscosity detecting method as claimed in claim 1, wherein detecting the amplitude values comprises detecting either upper amplitude values or lower amplitude values of the residual vibration waveform.

3. The liquid viscosity detecting method as claimed in claim 1, wherein calculating the logarithm attenuation ratio comprises calculating the logarithm attenuation ratio based on the amplitude values of the multiple cycles excluding a first half wave.

4. The liquid viscosity detecting method as claimed in claim 1, wherein calculating the logarithm attenuation ratio comprises calculating the logarithm attenuation ratio based on the amplitude values of the multiple cycles excluding an amplitude value having a smallest absolute value in the detected amplitude values.

5. A liquid droplet ejecting device comprising:

a piezoelectric type droplet ejecting head to which a drive waveform is applied, to pressurize a liquid chamber to eject a liquid droplet;

a drive waveform generator to apply the drive waveform to the droplet ejecting head;

a residual vibration detector to detect amplitude values of multiple cycles of a residual vibration waveform occurring within the liquid chamber after the drive waveform is applied; and a calculator to calculate a logarithm attenuation ratio based on the detected amplitude values of the multiple cycles, calculate a damping ratio based on the calculated logarithm attenuation ratio, and calculate a liquid viscosity of the liquid in the liquid chamber based on the calculated damping ratio.

6. The liquid droplet ejecting device as claimed in claim 5, wherein the residual vibration detector comprises a waveform processing circuit having a waveform processing function to detect the amplitude values of the residual vibration waveform occurring within the liquid chamber after the driving waveform is applied, and wherein the waveform processing circuit includes a filter circuit to reduce noise, an amplifier circuit to amplify the residual vibration waveform of a predetermined width where the noise is removed; and a peak-hold circuit to hold at least two peaks of the amplified residual vibration waveform as the amplitude values.

7. The liquid droplet ejecting device as claimed in claim 6, wherein the filter circuit includes a band-pass filter with a constant pass bandwidth.

8. The liquid droplet ejecting device as claimed in claim 7, further comprising:

a controller to control for correcting the drive waveform to be generated in the drive waveform generator, and to control the residual vibration detector, wherein the controller controls the amplifier circuit and the filter circuit for adjusting the pass bandwidth.

9. The liquid droplet ejecting device as claimed in claim 6, wherein the peak-hold circuit comprises a reset circuit having a reset function and a comparison circuit having a comparison function, and wherein the comparison circuit, operated based on the residual vibration waveform, controls resetting momentums of the reset circuit for adjusting release timings of holding the amplitude values.

10. The liquid droplet ejecting device as claimed in claim 6, wherein the droplet ejecting head further includes multiple piezoelectric elements to which the drive waveform is applied, to pressurize multiple liquid chambers, respectively, wherein the residual vibration detector further includes a switching element to switch connection and non-connection to the waveform processing circuit and the multiple piezoelectric elements, and wherein the waveform processing circuit detects two or more of the piezoelectric elements while the switching element is being switched.

11. The liquid droplet ejecting device as claimed in claim 6, further comprising:

a controller to control for correcting the drive waveform to be generated in the drive waveform generator, and to control the residual vibration detector, wherein the peak-hold circuit includes a reset circuit with a reset function, and wherein the controller controls a resetting momentum of the reset circuit for adjusting release timings of holding the amplitude values.

* * * * *